US012799737B2

(12) United States Patent
Diamondstone et al.

(10) Patent No.: US 12,799,737 B2
(45) Date of Patent: Nov. 17, 2026

(54) HOLD-DOWN CLIP FOR A SUSPENDED CEILING SYSTEM IN A CLEANROOM

(71) Applicant: WORTHINGTON ARMSTRONG VENTURE, Malvern, PA (US)

(72) Inventors: Daniel R. Diamondstone, Baltimore, MD (US); Sébastien Place, Chester Springs, PA (US); Yu Lin, Blue Bell, PA (US); Jason Ronald Ameen, Chester Springs, PA (US)

(73) Assignee: Worthington Armstrong Venture, Malvern, PA (US)

( * ) Notice: Subject to any disclaimer, the term of this patent is extended or adjusted under 35 U.S.C. 154(b) by 82 days.

(21) Appl. No.: 18/789,909

(22) Filed: Jul. 31, 2024

(65) Prior Publication Data

US 2025/0043570 A1 Feb. 6, 2025

Related U.S. Application Data

(60) Provisional application No. 63/530,822, filed on Aug. 4, 2023.

(51) Int. Cl.
*E04B 9/24* (2006.01)
*E04B 9/22* (2006.01)

(52) U.S. Cl.
CPC ..... *E04B 9/242* (2013.01); *E04B 9/22* (2013.01); *E04B 9/245* (2013.01); *E04B 9/247* (2013.01)

(58) Field of Classification Search
CPC . E04B 9/242; E04B 9/067; E04B 9/26; E04B 9/241; E04B 9/245; E04B 9/247; E04B 9/22
See application file for complete search history.

(56) References Cited

U.S. PATENT DOCUMENTS

| | | | | |
|---|---|---|---|---|
| 3,816,880 | A * | 6/1974 | Jacobs | E04B 9/006 362/150 |
| 4,760,981 | A * | 8/1988 | Hodges | F16L 3/006 248/57 |
| 5,519,976 | A * | 5/1996 | Gee | E04F 21/1838 52/715 |
| 7,647,739 | B2 * | 1/2010 | Boyd | E04B 9/32 52/712 |
| 7,797,902 | B2 * | 9/2010 | Hikai | E04B 1/7637 52/489.1 |
| 2010/0064618 | A1 * | 3/2010 | Boyd | E04B 9/225 52/506.07 |
| 2011/0078970 | A1 * | 4/2011 | Boyd | E04B 9/241 52/506.07 |
| 2025/0043570 | A1 * | 2/2025 | Diamondstone | E04B 9/067 |

* cited by examiner

*Primary Examiner* — Andrew J Triggs
(74) *Attorney, Agent, or Firm* — Stradley Ronon Stevens & Young, LLP

(57) ABSTRACT

A hold down clip for a suspended ceiling for an engineered space. The hold down clip is made of an elastic material such as stainless steel. The clip has an engagement section adapted to attach to perimeter angle molding of a suspended ceiling system using tines that may pierce a self-healing membrane such as caulk that seals the area between the perimeter angle molding and a structural wall. The clip also has a louvre element to stabilize its connection to the perimeter angle molding. Finally, the clip has a tongue section with a curved element that is lower than the louver element so that the clip is adapted to impart a downward force on a ceiling panel when the clip is installed in the system.

18 Claims, 6 Drawing Sheets

HOLD-DOWN CLIP FOR A SUSPENDED CEILING SYSTEM IN A CLEANROOM

RELATED APPLICATIONS

This application claims the benefit of priority to U.S. Provisional Patent Application Ser. No. 63/530,822, filed on Aug. 4, 2023, the contents of which are incorporated in this application by reference.

FIELD OF THE INVENTION

The present invention relates generally to suspended ceiling systems and more particularly to a hold-down clip for the suspended ceiling system that when installed exerts a continuous downward force on panels of the suspended ceiling to maintain the environmental integrity of a cleanroom.

BACKGROUND

Cleanrooms are areas in which particle concentration and environmental conditions are controlled within specified limits. The limits of the particle concentrations are normally set by the requirements of the process occurring within the space so that contamination of people, processes and equipment can be mitigated. A suspended ceiling system is commonly used in cleanrooms to provide access to utility lines, ductwork, and other infrastructure components above the ceiling while maintaining the environmental integrity of the engineered space below.

However, traditional suspended ceiling systems in clean rooms often face problems with stability and security. The panels used in these systems are susceptible to displacement or detachment due to vibrations caused by the cooling systems, equipment installation, and maintenance activities. The movement of the panels results in infiltration of contaminates into the engineered space and exposes sensitive equipment and infrastructure within the engineered space to environmental contaminates and/or potential damage.

Existing solutions for holding down suspended ceiling panels above engineered spaces have limitations. Adhesive tapes or glues are commonly used, but they are often messy, time-consuming to apply, and lack flexibility for repositioning or replacing panels. Mechanical fasteners and gaskets may also be used but can be challenging to install and may damage the panels or surrounding structures during installation or removal.

Accordingly, there is a need for a solution that provides a secure and reliable means of sealing a suspended ceiling panel that is easy to install and remove without affecting the environmental integrity of the engineered space. The disclosed invention is specifically designed to address the unique requirements and challenges with maintaining the environmental integrity of engineered spaces.

SUMMARY

According to an embodiment of the invention, a hold down clip for a suspended ceiling system for maintaining the panel position to maintain the stability of the environment of the enclosure is disclosed. The clip is made of an elastic material (e.g., stainless steel) and has an engagement section that includes: (1) a top edge, (2) a first engagement side edge projecting downward from the top edge and defining at least a portion of an outer edge of a first tine terminating at a first point, (3) a second engagement side edge also projecting downward from the top edge and defining at least a portion of an outer edge of a second tine terminating at a second point, and (4) a louver element connected to the engagement section at a first louver end. An extension section projects outward from the top edge at a substantially perpendicular angle. The extension section includes a first extension side edge and opposite second extension side edge with an extension aperture located between the first extension side edge and the second extension side edge. A tongue section projects downward from the extension section at a bend line. The tongue section includes a first tongue side edge and opposite second tongue side edge. The tongue section also includes a curled section wherein a portion of the curled section projects below the first louver end.

In certain embodiments, the first engagement side edge and the second engagement side edge of the clip are substantially parallel. In other embodiments, the first extension side edge and the second extension side edge of the clip are substantially parallel. In further embodiments, the first extension side edge and the second extension side edge of the clip are substantially parallel.

In certain embodiments, at least one of the first engagement side edge or the second engagement side edge define a point of either the first tine or the second tine.

In certain embodiments, the louver element further includes at least one barb located between the first louver end and terminal louver end, the barb projecting outward from the louver element in the direction of the engagement section. In other embodiments, the louver element further comprises a second bend wherein the terminal louver end projects away from the engagement section.

In certain embodiments, the extension aperture projects into the tongue section.

In certain embodiments at least one of the first point or the second point is located below the louver terminal end.

In certain embodiments, the clip is incorporated into a suspended ceiling system where the clip attaches to a perimeter angle molding of the ceiling system at the engagement section and imparts a downward force on a panel of the ceiling system against the flange of the perimeter angle molding.

BRIEF DESCRIPTION OF DRAWINGS

The invention is best understood from the following detailed description when read in conjunction with the accompanying drawing. It is emphasized that, according to common practice, the various features of the drawing are not to scale. On the contrary, the various features are arbitrarily expanded or reduced for clarity. Included in the drawing are the following figures.

DETAILED DESCRIPTION

Figure 1A:
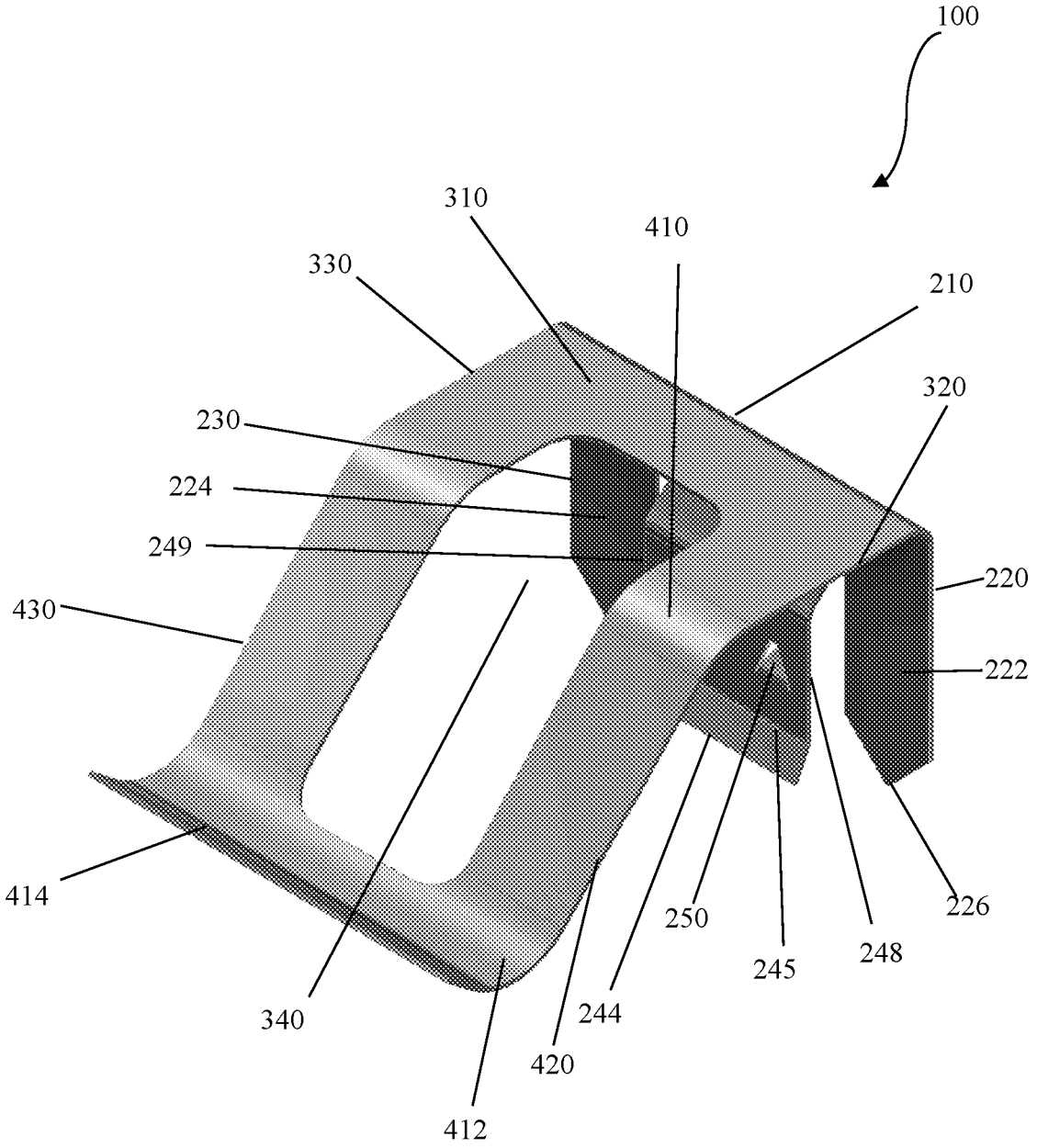
FIG. 1A is a top right perspective view of a hold down clip according to an embodiment of the present invention.
Figure 1B:
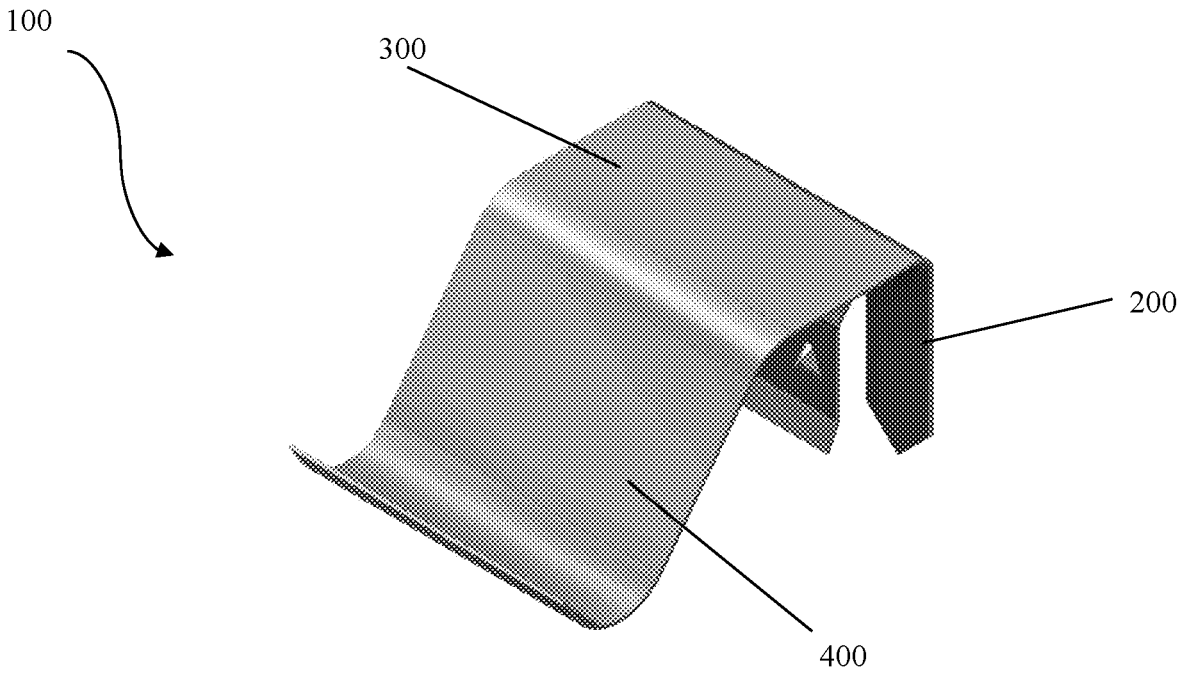
FIG. 1B is a top right perspective view of a hold down clip according to an embodiment of the present invention.
Figure 2A:
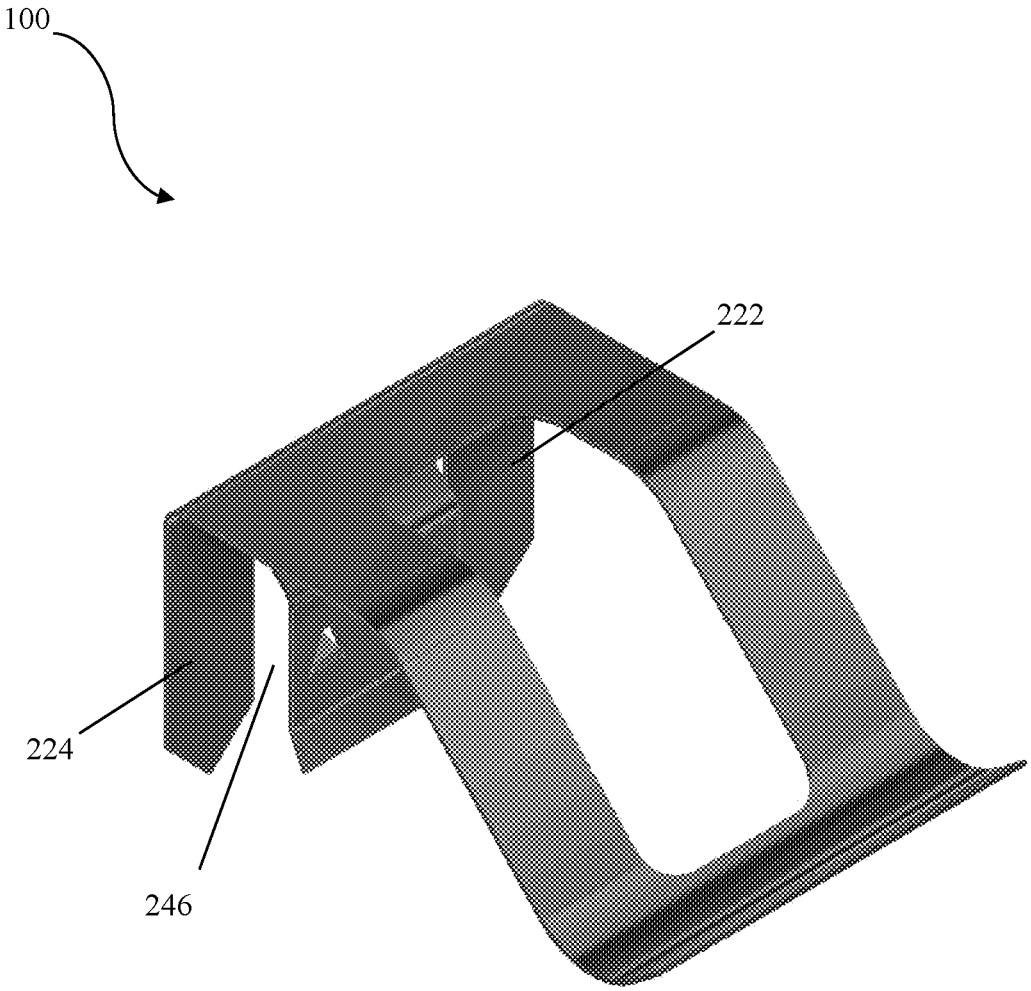
FIG. 2A is a top left perspective view of the hold down clip of FIG. 1A.
Figure 2B:
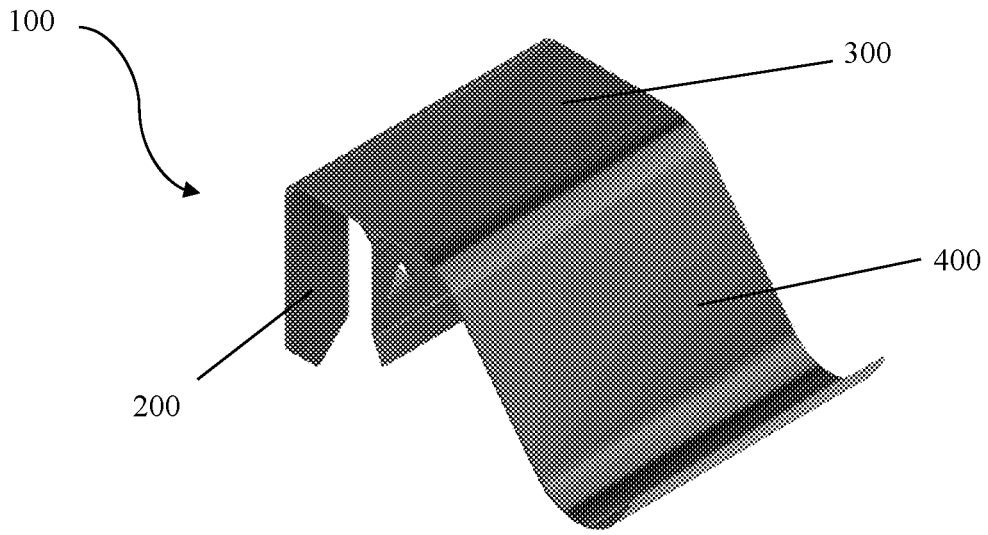
FIG. 2B is a top left perspective view of the hold down clip of FIG. 1B.

The features and benefits of the disclosed pocket and adjustable trim pieces standoff for a suspended ceiling system are illustrated and described by reference to exemplary embodiments. The disclosure also includes the drawing, in which like reference numbers refer to like elements throughout the various figures that comprise the drawing. This description of exemplary embodiments is intended to be read in connection with the accompanying drawing, which is to be considered part of the entire written description. Accordingly, the disclosure expressly should not be limited to such exemplary embodiments illustrating some possible non-limiting combinations of features that may exist alone or in other combinations of features.

In the description of embodiments, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be construed or operated in a particular orientation. Terms such as "attached," "affixed," "connected," "coupled," "interconnected," and similar terms refer to a relationship wherein structures are secured or attached to one another either directly or indirectly through intervening structures, as well as both moveable or rigid attachments or relationships, unless expressly described otherwise.

Figure 3:
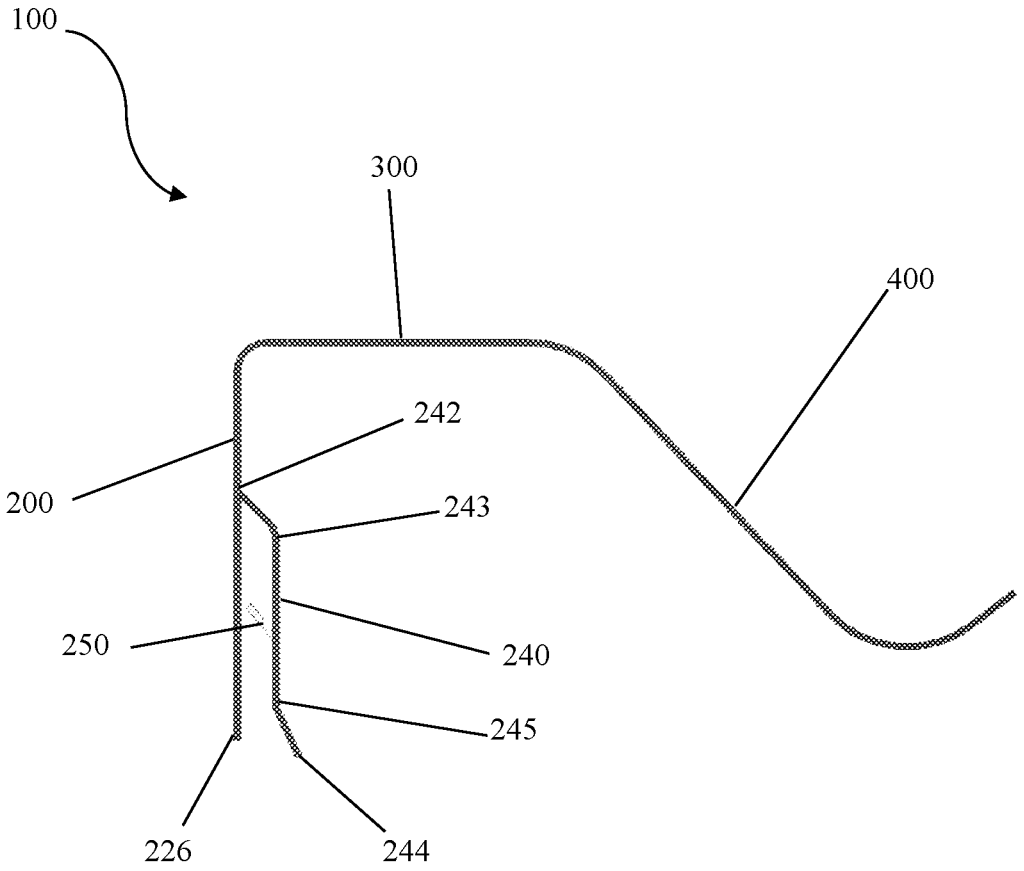
FIG. 3 is a left side view of the hold down clip of FIG. 1B.
Figure 4:
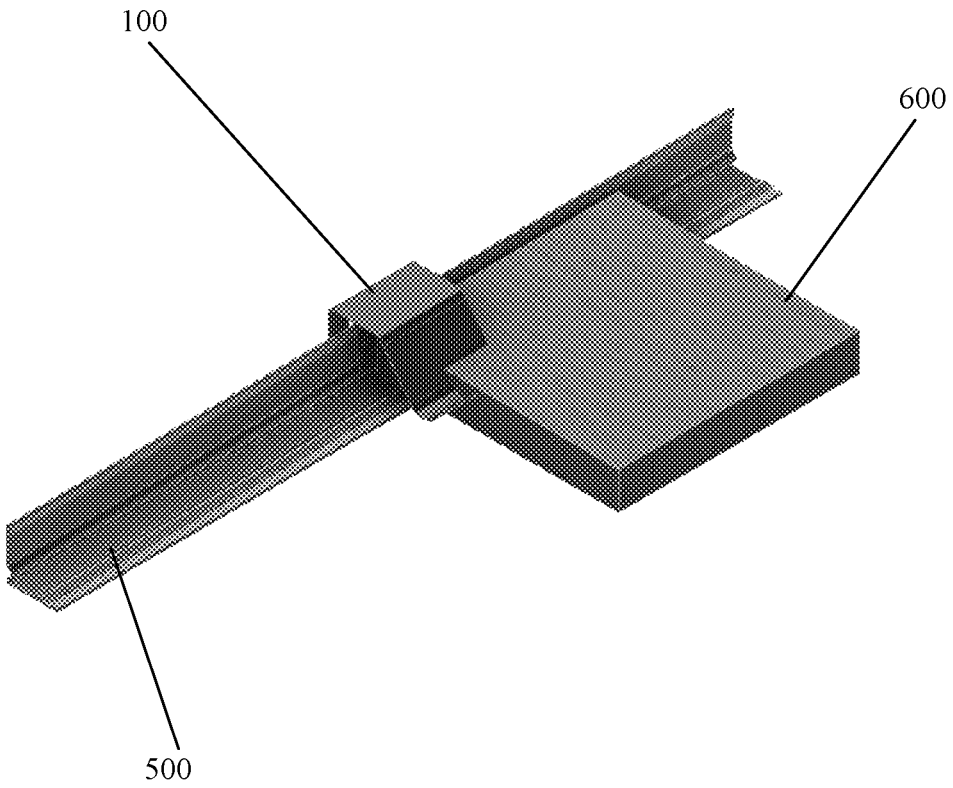
FIG. 4 is a top left perspective view FIG. 1B and the manner by which the clip engages with a border section of the suspended ceiling and a panel.

Referring to FIGS. 1A, 1B, 2A, and 2B, a hold down clip 100 is provided according to an exemplary embodiment of the present invention. FIG. 3 depicts a side view of the hold down clip 100 according to an exemplary embodiment. As depicted in FIG. 3 and discussed in more detail below, the hold down clip 100 includes three sections: a perimeter engagement section 200 connected to an extension section 300 which is further connected to a tongue section 400. As depicted in FIG. 4, the perimeter engagement section 200 attaches to perimeter angle molding 500, the tongue section 400 contacts a panel 600 and imparts a biasing force downward on a panel 600 to maintain the position of the panel 600 and opposite sides of the extension section 300 connect the engagement section 200 and the tongue section 400.

Perimeter Engagement Section

The perimeter engagement section 200 includes: (1) a top edge 210, (2) a first engagement side edge 220 projecting downward from the top edge 210 and defining an outer side edge of a first tine 222, (3) a second engagement side edge 230 projecting downward from the top edge 210 and defining an opposite outer side edge of a second tine 224, and (4) a louver element 240 projecting outward from the perimeter engagement section 200 and away from the top edge 210.

Engagement Side Edges

In certain embodiments, the first engagement side edge 220 and the second engagement side edge 230 may both project downward from the top edge 210 forming an angle that is substantially perpendicular (e.g., a right angle) from top edge 210. In other embodiments, the first engagement side edge 220 and the second engagement side edge 230 may both project downward from the top edge 210 forming either: (1) an acute angle with the top edge 210, or (2) an obtuse angle with top edge 210. In other words, the engagement section may taper away from or towards the top edge 210 in a continuous straight line manner. In further embodiments, the first engagement side edge 220 and the second engagement side edge 230 may project downward from the top edge 210 at different angles. For example, the first engagement side edge 220 may form a substantially perpendicular angle with the top edge 210 while the second engagement side edge 230 may form an acute angle with the top edge 210.

Louver Element

The louver element 240 includes a first end 242 connected to the perimeter engagement section 200 a first bend 243 and an opposite terminal end 244. The louver element is adapted to engage perimeter angle molding 500. The louver element 240 may be punched out from the perimeter engagement section 200 thereby defining a louver aperture 246. The louver element 240 may include a third engagement side edge 248 closest to the first tine 222 and a fourth engagement side edge 249 closest to the second tine 224. In certain embodiments, such as depicted in FIGS. 1-3, a section of the louver surface between the third engagement side edge 248 and the fourth engagement side edge 249 may be substantially parallel to the tines 222, 224.

In certain embodiments, at least one barb 250 may project outward from the engagement side 248 in the direction of the perimeter engagement section 200 and may be adapted to engage with perimeter angle molding 500. In other embodiments, such as depicted in FIGS. 1-3, there may be two barbs 250. Furthermore, the barbs 250 may take on shapes consisting of: triangles, squares, rectangles, circles, ovals, diamond, or any other polygonal shape.

In certain embodiments, the louver element 240 is adapted to apply a spring force onto the perimeter angle molding 500 in the direction of the perimeter engagement section 200 to assist in connecting the clip 100 to the perimeter angle molding 500. In applying such a spring force, the louver element 240 may initially projects in a direction away from the perimeter engagement section 200 and then at a first bend 243 project back in a direction either parallel to or back towards the perimeter engagement section 200.

In other embodiments, the louver element 240 may include a second bend 245 resulting in a terminal end 244 of the louver element 240 projecting away from the perimeter engagement section 200. Such a second bend 245 may assist in guiding the perimeter angle molding 500 towards engagement with the louver element 240.

Tines

As outlined above, the first tine 222 and the second tine 224 project downward from the top edge 210 with the first engagement side edge 220 defining the outer side edge of the first tine 222 and the second engagement side edge 230 defining the outer side edge of the second tine 224. Each tine terminates at a point 226 which extends further from the top edge 210 than the terminal end 244 of the louver element 240. For example, the point 226 may extend up to an inch further from the top edge 210 than the terminal end 244 of the louver element 240. The purpose of the tines is to pierce a self-healing membrane (e.g., caulk) that has been applied between a structural wall and perimeter angle molding 500 thereby maintaining the environmental stability of the engineered space.

In certain embodiments, the first and second engagement side edges 220, 230 do not terminate at the points 226 of the tines 222, 224. For example, such as depicted in FIGS. 1-3, the point 226 may be formed by a bottom triangular shaped section. In other embodiments, the point 226 is formed along the engagement side edges 220, 230.

In certain embodiments the louvre element 240 may extend below the tines 222, 224. For example, the terminal end 244 of the louver element 240 may be about 0.05 inches below the point 226 of the tines 222, 224,

Extension Section

The extension section 300 includes: (1) an engagement surface 310, (2) a first extension side edge 320 projecting outward from the top edge 210 and defining an outer side edge of the engagement section 300, (3) a second extension side edge 330 projecting outward from the top edge 210 and defining an opposite outer side edge of the engagement section 300, and (4) optionally an extension aperture 340 located within the extension surface 310 and between the first extension side edge 320 and the second extension side edge 330.

Extension Side Edges

In certain embodiments, the first extension side edge 320 and the second extension side edge 330 may both project outward downward from the top edge 210 forming an angle that is substantially perpendicular (e.g., a right angle) from top edge 210. In other embodiments, the first extension side edge 320 and the second extension side edge 330 may both project outward from the top edge 210 forming either: (1) an acute angle with the top edge 210, or (2) an obtuse angle with top edge 210. In other words, the extension section may taper away from or towards the top edge 210 in a continuous straight line manner. In further embodiments, the first extension side edge 320 and the second extension side edge 330 may project outward from the top edge 210 at different angles. For example, the first extension side edge 320 may form a substantially perpendicular angle with the top edge 210 while the second extension side edge 330 may form an acute angle with the top edge 210.

Extension Aperture

In certain embodiments, such as those depicted in FIGS. 1-3, the extension aperture 340 may take on the shape of a rectangular hole with rounded corners. In other embodiments, the extension aperture 340 may take on shapes consisting of: triangles, squares, rectangles, circles, ovals, diamond, or any other polygonal shape with sharp or rounded corners.

Tongue Section

The tongue section 400 includes: (1) a tongue bend 410 on one edge with an opposite curled section 412 having a terminal edge 414, (2) a first tongue side edge 420 projecting outward from the tongue bend 410 and defining an outer side edge of the tongue section 400, (3) a second tongue side edge 430 projecting outward from the tongue bend 410 and defining an opposite outer side edge of the tongue section 400.

Tongue Side Edges

In certain embodiments, the first tongue side edge 420 and the second tongue side edge 430 may both project outward and downward from the tongue bend 410 forming an angle that is substantially perpendicular (e.g., a right angle) from the tongue bend 410. In other embodiments, the first tongue side edge 420 and the second tongue side edge 430 may both project outward from the tongue bend 410 forming either: (1) an acute angle with the tongue bend 410, or (2) an obtuse angle with the tongue bend 410. In other words, the extension section may taper away from or towards the tongue bend 410 in a continuous straight line manner. In further embodiments, the first tongue side edge 420 and the second tongue side edge 430 may project outward and downward the tongue bend 410 at different angles. For example, the first tongue side edge 420 may form a substantially perpendicular angle with the tongue bend 410 while the second tongue side edge 430 may form an acute angle with the tongue bend 410.

Curled Section

As outlined above, the clip 100 includes a curled section 412 opposite the tongue bend 410. The curled section 412 curls upwards from the tongue section 400 defining a trough. The purpose of the curled section 412 is to increase the surface area available to contact the panel 600.

In certain embodiments, the trough bottom of the curled section 412 is lower than the barb 250 of the louver element 240. For example, the trough of the curled section 412 may be about 0.1 inches below the barb 250 of the louver element 240. Indeed, the trough of the curled section 412 may be about 0.8 inches vertically below the top edge 210.

Perimeter Angle Molding

In certain embodiments, the disclosed hold down clip is attached to perimeter angle molding of the suspended ceiling system. Perimeter angle molding may also be referred to as perimeter trim or a perimeter channel. It is installed along the perimeter of the ceiling, where the ceiling tiles or panels meet the walls or other vertical surfaces.

Perimeter angle molding serves both functional and aesthetic purposes in suspended ceilings. It adds structural support, provides a neat finish to the edges, conceals the grid system, and can minimize air leakage from the below engineered space. Indeed, the molding may act as a support structure for the ceiling tiles or panels, helping to hold them in place and prevent sagging or displacement. Indeed, in certain embodiments, the suspended ceiling system may need to transition or connect with other types of surfaces, such as bulkheads, beams, or walls. Perimeter angle molding can be used to create a smooth transition and cover any gaps or joints between the suspended ceiling and these adjacent surfaces.

Piece Dimensions

In certain embodiments, the perimeter engagement section 200 may be about 1 inch as measured vertically from the top edge 210 to the terminal end 244 of the louver element 240. In such embodiments the distance from the top edge 210 to the points 226 of the tines 222, 224 may be 0.96 inches. In such embodiments, the width of the extension section and tongue sections may be about 1.375 inches as measured from either the first extension side edge 320 to the second extension side edge 330 or from the first tongue side edge 420 to the second tongue side edge 430. Finally, the horizontal distance between the top edge 210 and the terminal edge 414 may be about 1.865 inches.

Materials of Manufacture

It will be understood that the clip 100 may be constructed from any bendable elastic material such as metals, polymers, or carbon fiber. In an exemplary embodiment, both the clip 100 is manufactured from stainless steel.

The material gauge from which the clip 100 may be constructed may be between approximately 0.01 inches and 0.2 inches. For example, the material gauge may be approximately 0.015 inches.

The foregoing description of preferred embodiments of the invention should be taken as illustrating, rather than as limiting the present invention. As will be readily appreciated, numerous variations and combinations of the features set forth above can be utilized without departing from the present invention. Such variations are not regarded as a departure from the spirit and scope of the invention, and all such variations are intended to be included within the scope of the invention.

We claim:

1. A hold down clip for a suspended ceiling, the hold down clip comprising:

an engagement section including: a top edge, a first engagement side edge defining at least a portion of an outer edge of a first tine terminating at a first point, the first engagement side edge projecting downward from the top edge, a second engagement side edge defining at least a portion of an outer edge of a second tine terminating at a second point, the second engagement side edge projecting downward from the top edge, and a louver element located between the first tine and the second tine, the louver element including a first louver end connected to the perimeter engagement section, a first bend, and a terminal louver end opposite the first end;

an extension section projecting outward at a substantially perpendicular angle from the perimeter engagement section at the top edge, the extension section including a first extension side edge and opposite second extension side edge with an extension aperture located between the first extension side edge and the second extension side edge; and a tongue section projecting downward from the extension section at a bend line having a first tongue side edge and opposite second tongue side edge, the tongue section including a curled section wherein a portion of the curled section projects below the first louver end, wherein the hold down clip is made of an elastic material.

2. The hold down clip of claim 1, wherein the first engagement side edge and the second engagement side edge are substantially parallel.

3. The hold down clip of claim 1, wherein the first extension side edge and the second extension side edge are substantially parallel.

4. The hold down clip of claim 1, wherein the first tongue side edge and the second tongue side edge are substantially parallel.

5. The hold down clip of claim 1, wherein the louver element further includes at least one barb located between the first louver end and the terminal louver end, the barb projecting outward from the louver element in a direction of the engagement section.

6. The hold down clip of claim 1, wherein the louver element further comprises a second bend wherein the terminal louver end projects away from the engagement section.

7. The hold down clip of claim 1, wherein the extension aperture projects into the tongue section.

8. The hold down clip of claim 1, wherein at least one of the first point or the second point is located below the louver terminal end.

9. The hold down clip of claim 1, wherein the elastic material is stainless steel.

10. A suspended ceiling system for maintaining environmental stability of an enclosure the ceiling system comprising:

perimeter angle molding having at least one flange projecting outward from the perimeter angle molding, a panel, and a hold down clip attached to the perimeter angle molding and adapted to exert a springing force onto the panel thereby holding the panel against the flange, the hold down clip comprising:

an engagement section including: a top edge, a first engagement side edge defining at least a portion of an outer edge of a first tine terminating at a first point, the first engagement side edge projecting downward from the top edge, a second engagement side edge defining at least a portion of an outer edge of a second tine terminating at a second point, the second engagement side edge projecting downward from the top edge, and a louver element located between the first tine and the second tine, the louver element including a first louver end connected to the perimeter engagement section, a first bend, and a terminal louver end opposite the first end;

an extension section projecting outward at a substantially perpendicular angle from the perimeter engagement section at the top edge, the extension section including a first extension side edge and opposite second extension side edge with an extension aperture located between the first extension side edge and the second extension side edge; and a tongue section projecting downward from the extension section at a bend line having a first tongue side edge and opposite second tongue side edge, the tongue section including a curled section wherein a portion of the curled section projects below the first louver end, wherein the hold down clip is made of an elastic material.

11. The ceiling system of claim 10, wherein the first engagement side edge and the second engagement side edge are substantially parallel.

12. The ceiling system of claim 10, wherein the first extension side edge and the second extension side edge are substantially parallel.

13. The ceiling system of claim 10, wherein the first tongue side edge and the second tongue side edge are substantially parallel.

14. The ceiling system of claim 10, wherein the louver element further includes at least one barb located between the first louver end and the terminal louver end, the barb projecting outward from the louver element in a direction of the engagement section.

15. The ceiling system of claim 10, wherein the louver element further comprises a second bend wherein the terminal louver end projects away from the engagement section.

16. The ceiling system of claim 10, wherein the extension aperture projects into the tongue section.

17. The ceiling system of claim 10, wherein at least one of the first point or the second point is located below the louver terminal end.

18. The ceiling system of claim 10, wherein the elastic material is stainless steel.

* * * * *